United States Patent [19]

Middleby

[11] 3,953,952

[45] May 4, 1976

[54] CLADDING FOR BUILDING CONSTRUCTIONS AND METHOD FOR INSTALLING THE SAME

[76] Inventor: Samuel Middleby, Pacific Highway, Newcastle, New South Wales, Australia, 2280

[22] Filed: Sept. 16, 1974

[21] Appl. No.: 506,109

[52] U.S. Cl. ..... 52/511; 52/550; 52/551; 52/552

[51] Int. Cl.[2] ..... E04D 1/34

[58] Field of Search ..... 52/511, 512, 548, 550, 52/552, 549, 537, 551

[56] References Cited

UNITED STATES PATENTS

| | | | |
|---|---|---|---|
| 977,796 | 12/1910 | Hall | 52/511 |
| 1,359,167 | 11/1920 | Grisworld | 52/548 |
| 2,308,442 | 1/1943 | Diggs | 52/549 |
| 2,387,317 | 10/1945 | Cunnington | 52/511 |
| 2,483,776 | 10/1944 | Kroler | 52/550 |
| 2,533,786 | 12/1950 | Gangnier | 52/511 |
| 3,200,551 | 8/1965 | Takeway | 52/511 |
| 3,309,822 | 3/1967 | Darkin | 52/549 |
| 3,608,266 | 9/1971 | Satkin | 52/511 |
| 3,643,394 | 2/1972 | Johnson | 52/309 |
| 3,826,055 | 7/1974 | Bobzin | 52/511 |

FOREIGN PATENTS OR APPLICATIONS

| | | | |
|---|---|---|---|
| 225,891 | 7/1962 | Austria | 52/537 |

*Primary Examiner*—Frank L. Abbott
*Assistant Examiner*—H. Raduazo
*Attorney, Agent, or Firm*—Phillips, Moore, Weissenberger Lempio & Strabala

[57] ABSTRACT

A sheet of cladding has an unbroken weather resistant face formed on one side and attaching devices secured on the opposite side thereof to adapt it for attachment to the frame structure of a building. The attaching devices each comprise a metallic strip having tongues deformed therefrom and adapted to be nailed to the frame structure from within. The strip is preferably secured to the cladding by upset barbs punched-out of the strip to pierce the cladding into embedded relationship therein.

7 Claims, 3 Drawing Figures

FIG.2
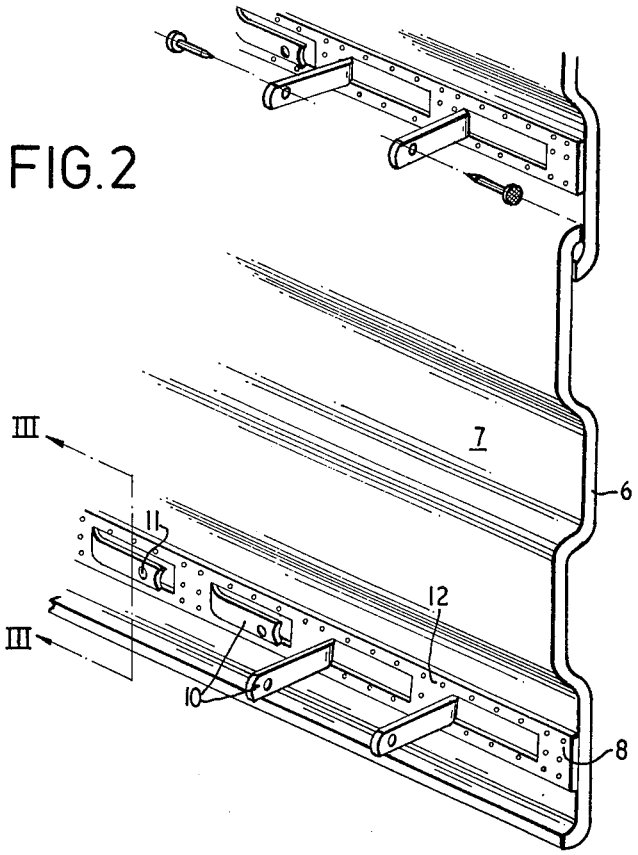
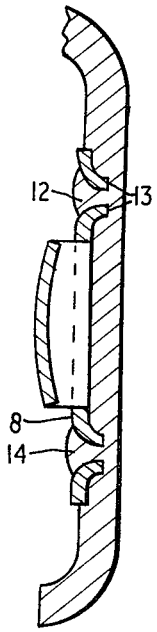
FIG.3

CLADDING FOR BUILDING CONSTRUCTIONS AND METHOD FOR INSTALLING THE SAME

BACKGROUND OF THE INVENTION

1. Field of the Invention

This invention relates to a wall or roof cladding for a timber or metal frame building. More specifically, the invention is concerned with enabling a sheet of cladding to be attached to the frame more expeditiously and securely than has hitherto been possible.

2. Description of the Prior Art

Sheets of cladding, composed of plastic or other suitable materials, are normally secured to a timber or metal frame building by driving nails through them from the front and into the supporting frame. Apart from being unsightly, the use of nails impairs the weather resistant properties of the sheeting and can result in fracturing of the sheeting in the vicinity of the nail holes. A further disadvantage is that such sheeting has to be nailed in from the front of the building and if the indivudual panels of sheeting are large, it is easy for a nail to miss the support frame behind the sheeting with a result that the cladding is inadequately supported.

OBJECTS OF THE INVENTION

One object of the invention is the provision of an improved and economical sheet of cladding for a frame building which exhibits a high degree of wear resistance and structural integrity.

Another object of the invention is to provide a method and means to expedite installation of such cladding to a frame of a building from interiorly thereof and to avoid costly scaffolding.

SUMMARY OF THE INVENTION

In accordance with the present invention, cladding for application to a frame of a building comprises a sheet of material having at least one attaching device secured to one face thereof, the attaching device being in strip form and being formed along its length with a series of tongues which are deformable outwardly from the plane of the strip. The tongues normally lie adjacent to the strip so that the cladding can be transported in a compact manner, but are readily deformable away from the plane of the strip to enable them to be secured to a frame of the building by, for example, hammering a nail through an aperture preformed through each tongue. It will be appreciated that the fixing of the cladding in position is carried out entirely from the inside of the building so that the builder does not have to use guess-work or measurements in order to determine where the frame is.

The cladding may be metal, but preferably comprises plastic material, such as a sheet of fibreglass reinforced plastic. The sheet may be configured or patterned on its weather-resistant face. The attaching device may be attached to the sheeting by a suitable resin glue, but is preferably pressed or molded into the sheet during formation thereof.

The strip or strips are preferably metallic, such as aluminum, and the tongues are suitably formed from an intermediate portion of the aluminum strip and conveniently are given a semi-cylindrical cross section and are joggled slightly out of the plane of the strip to ensure that they are not bonded to the sheeting when the strip is fixed in position. However, this invention also contemplates the utilization of a metallic cladding sheet having the tongues formed from a plastic strip bonded thereto. Such bonding may be performed by welding or adhesion.

BRIEF DESCRIPTION OF THE DRAWINGS

The invention will now be described in more detail, by way of example, with reference to the accompanying drawings in which:

FIG. 2 is a perspective view of the rear surface of parts of two cladding sheets which overlap one another; and FIG. 3 is a fragmentary section, taken in the direction of arrows III—III in FIG. 2.

DETAILED DESCRIPTION OF THE PREFERRED EMBODIMENT

Figure 1:
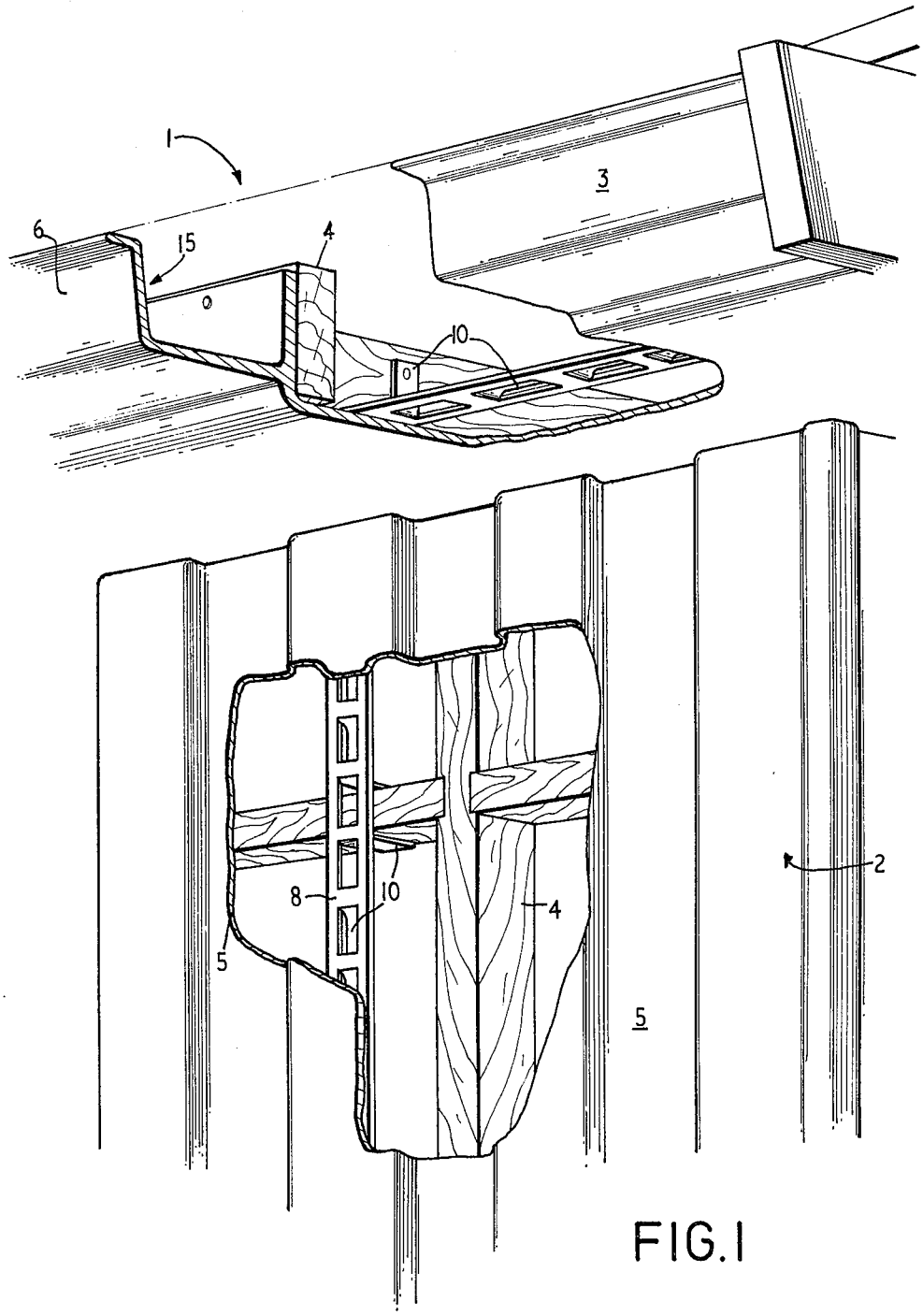
FIG. 1 is a perspective view, partly broken away to show internal details, of a wall and eave portion of a timber framed house having its external walls provided by cladding sheets.

A dwelling house, partly shown at 1, has a wall 2 and a box-in eave 3. The wall and eave are formed by timber framing 4 to which are applied sheets of cladding 5 and 6. The cladding 6 for boxing-in the eave has a different cross section to that used for cladding the wall 2. As the cross section of the cladding sheets may be suitably varied and yet fall within the scope of this invention, only the sheets used for cladding the wall 2 will be described in detail.

Referring to FIG. 2, it will be seen that the cladding sheet for the wall is of generally castellated cross section and is preferably made of a plastic material providing a smooth and unbroken weather-proof surface 9 on a first side or front face of the sheet. The second side or rear face 7 of the sheet is reinforced with glass fibre integrally molded with the sheet. The parallel castellations of the sheet provide channels and every third such channel, for example, has molded into the fibreglass surface of the sheet an attaching device provided by an aluminum strip 8. Material, such as layer of bonding resin, may be used to assist the attachment of the strip 8 within a channel of the sheet 5.

Each strip 8 is provided along its length with spaced tongues 10 which are joggled out of the plane of the strip 8 prior to attaching the strip to the cladding sheet. The free end of the tongue 10 is perforated at 11 to provide a nail hole. Additionally, the strip 8 is provided with a multiplicity of punched-through apertures 12 which assist anchoring of the strip to the cladding 5 as is clear from FIG. 3.

The punched-through apertures are of pyramidal shape so that each provides four projecting teeth or barbs 13 directed towards the sheet 5. During the molding of the strip 8 to the sheet 5, the resinous plastic material of the sheet is forced into the apertures 12 and sets to provide keys 14 which, with the projections 13 embedded in the sheet 5, hold the strp 8 firmly anchored to the sheet. As is clearly shown in FIG. 3, the tongues tend to have a semi-cylindrical cross section so that should they come into contact with the resin of the sheet 5 before it hardens, such contact is confined to corner contact along the edges of the tongue which can be easily broken after the resinous material has hardened.

The cladding sheets are assembled on the frame 4 as follows. Each cladding sheet is overlapped at its edge with the cladding sheet last applied, as shown in FIG. 2.

The appropriate tongues 10 which are to be nailed to the timber frames are bent out of the plane of the strip and nailed in position on the frame, as shown in FIG. 1. As the tongues 10 are closely spaced, adequate attachment of the cladding sheet to the frame can be assured.

It will particularly be noticed that the fitting of the cladding sheets into overlapping relationship to one another and the subsequent nailing or screwing of the tongues to the frame can be carried out by a workman from the inside of the building. The sheets of cladding can therefore be made larger than hitherto and there is no risk, as was formerly the case, of a nail driven through from the front of the cladding sheet missing entirely the timber frame behind it.

In the case of the cladding used for boxing in the eaves of the building, it is shaped to provide a gutter 15 projecting out beyond the eaves so that the attachment of a separate gutter is unnecessary. The fixing of the cladding sheet 6 is carried out in the same way as the cladding sheets 5, and only the shape of the sheet is different and the gutter is additionally nailed to frame 4.

It will be understood that the cross section of the cladding can be substantially sinuous, castellated or indeed flat. However, it is preferred that the cladding sheets be formed with parallel channels so that the strips together with their joggled out tongues are totally within the cavities of the channels and there is then no risk of the tongues being inadvertently deformed during transportation and stacking of the sheets. The sheets can also be attached to the supporting frame while in firm contact therewith.

Cladding provided by the above described sheets has a clean external appearance, is devoid of nail holes and is firmly attached to the supporting frame. The cladding also is simpler to use and quicker to erect than conventional cladding, and can be precolored to avoid painting.

Numerous modifications of the above described cladding sheets can be made without departing from the invention. For example, the strips used to secure the sheeting in position can themselves be made of a plastic material and, likewise, if the cladding sheeting is metal, the metal strip can be fixed to it by spot welding. Although the use of holes in the tongues to assist their nailing to the supporting frame is preferred, the use of such holes is not essential. Likewise, the punched-through apertures are only really necessary when fixing a metal strip, such as the aluminum one illustrated, to plastic material such as fibreglass where some form of rough surface is necessary in order to provide a satisfactory bonding to the fibreglass. Throughout this specification the term fibreglass is used to denote a layer of glass fibre embedded in a solid matrix of synthetic resinous material.

I claim:

1. A cladding adapted for installation on a skeleton frame of a building or the like comprising a sheet of material having an undulating cross section and a smooth weather surface on a first face thereof, a glass fibre reinforced synthetic plastic layer formed on an opposite, second face of said sheet and a plurality of parallel channels defined thereon, by said undulating cross section, a thin and continuous strip composed of a deformable metallic material lying in a parallel channel formed in the second face of each sheet, each strip having portions thereof at least partially embedded in said plastic layer, and a plurality of tongue means closely spaced along the entire length of said strip and formed integrally therewith to normally lie on a longitudinal centerline of said strip and substantially in a plane thereof and bendable by light finger pressure out of said plane, whereby said tongue means may be selectively secured by nailing to transversely extending spaced frame members of a building and the cladding thereby tied in tension thereto.

2. The cladding of claim 1 wherein each of said tongue means has a semi-cylindrical cross section.

3. The cladding of claim 2 further comprising means forming a perforation through an end-portion of each of said tongues to define a nail hole therethrough.

4. A cladding adapted for installation on a skeleton frame of a building or the like comprising a rigid and substantially non-deformable sheet having a weatherproof surface provided on a first face thereof, said sheet further comprises an undulating cross section providing parallel channels in a second face thereof, attachment means rigidly attaching said strip to said sheet and penetrating into said sheet to terminate short of the weather surface thereof, and a plurality of tongue means integrally formed in closely spaced relationship along the entire length of said strip, substantially parallel thereto, having a semi-cylindrical cross section and bendable by light finger pressure out of a plane thereof whereby said tongue means may be selectively secured by nailing to transversely extending frame members of said building and the cladding thereby tied in tension thereto.

5. The cladding of claim 4 wherein said attachment means comprises a plurality of barbs formed on one side of said strip, each of said barbs defined by a punched aperture formed completely through said strip.

6. The cladding of claim 5 wherein a plurality of longitudinally spaced barbs are formed adjacent to each lateral edge of said strip, said aperture defining a set of four barbs disposed in a pyramidal shape.

7. The cladding of claim 6 wherein said sheet is composed of a plastic material and a key of plastic material is extruded into a respective aperture in locking relationship within a respective set of barbs.

* * * * *

UNITED STATES PATENT AND TRADEMARK OFFICE

CERTIFICATE OF CORRECTION

PATENT NO. : 3,953,952

DATED : May 4, 1976

INVENTOR(S) : SAMUEL MIDDLEBY

It is certified that error appears in the above-identified patent and that said Letters Patent are hereby corrected as shown below:

Col. 4, line 22 (Claim 2), change "semi-cylindrical" to --part circular--.

Col. 4, between lines 32 and 33 (Claim 4), insert:

--a thin and continuous strip composed of a deformable material disposed on said opposite, second face of said sheet,--

Col. 4, line 39 (Claim 4), change "semi-cylindrical" to --part circular--.

Signed and Sealed this

Third Day of August 1976

[SEAL]

*Attest:*

RUTH C. MASON
*Attesting Officer*

C. MARSHALL DANN
*Commissioner of Patents and Trademarks*